United States Patent [19]

McHenry

[11] 4,048,738

[45] Sept. 20, 1977

[54] DISPLAY SIGN AND REPLACEABLE MESSAGE

[76] Inventor: Edward R. McHenry, 2935 Hammon Drive, Youngstown, Ohio 44511

[21] Appl. No.: 708,542

[22] Filed: July 26, 1976

[51] Int. Cl.[2] ..... G09F 3/18

[52] U.S. Cl. ..... 40/16; 40/124.2

[58] Field of Search ..... 40/140, 128, 124.2, 40/16, 64

[56] References Cited

U.S. PATENT DOCUMENTS

| | | | |
|---|---|---|---|
| 758,088 | 4/1904 | Mixer | 40/64 R |
| 2,802,291 | 8/1957 | Bach et al. | 40/64 |
| 3,660,918 | 5/1972 | Bourseau | 40/64 R |
| 3,676,942 | 7/1972 | Elrod | 40/128 |
| 3,778,915 | 12/1973 | Freeman et al. | 40/128 |

*Primary Examiner*—Russell R. Kinsey
*Assistant Examiner*—Wenceslao J. Contreras
*Attorney, Agent, or Firm*—Oldham & Oldham Co.

[57] ABSTRACT

The sign has changeable indicia; it has a frame enclosing a center area and a plurality of flattened tubular vertically aligned indicia carriers filling the center area of the frame, the indicia carriers being slidably interlocked with each other, and indicia plates slidably received in at least one indicia carrier to present a display message through the front of the sign.

4 Claims, 5 Drawing Figures

FIG. 1
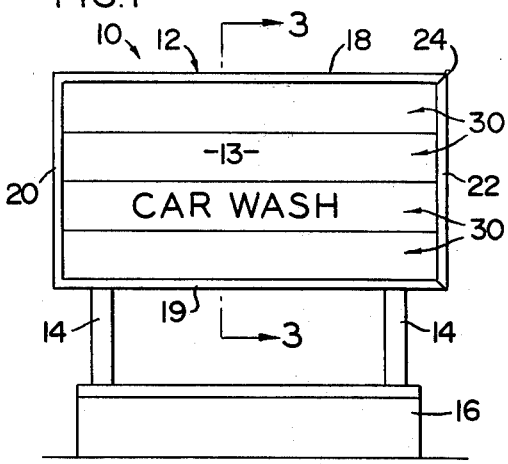
FIG. 2
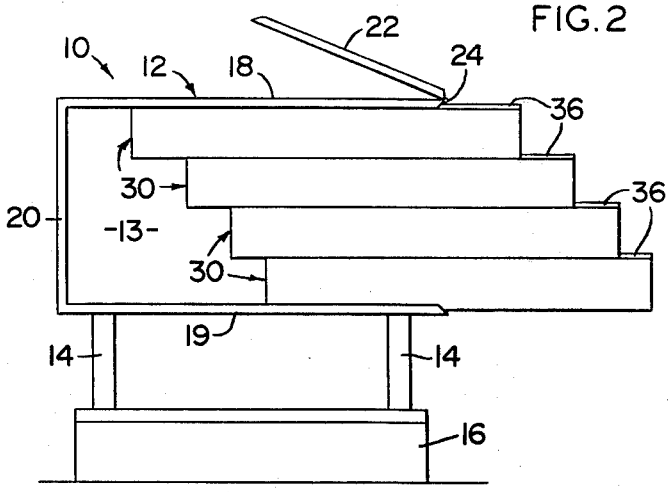
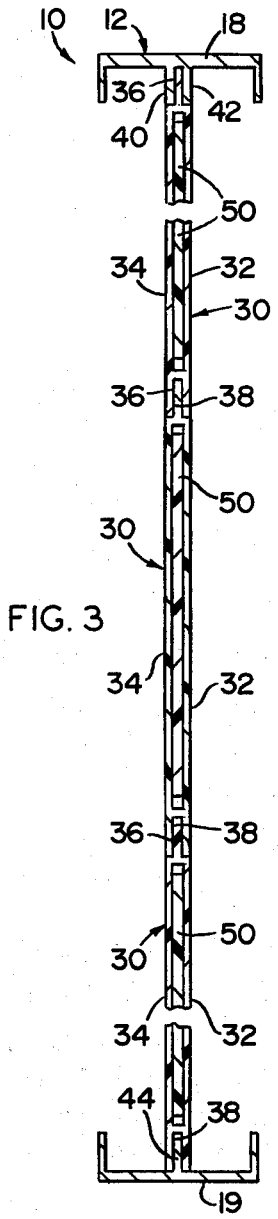
FIG. 3
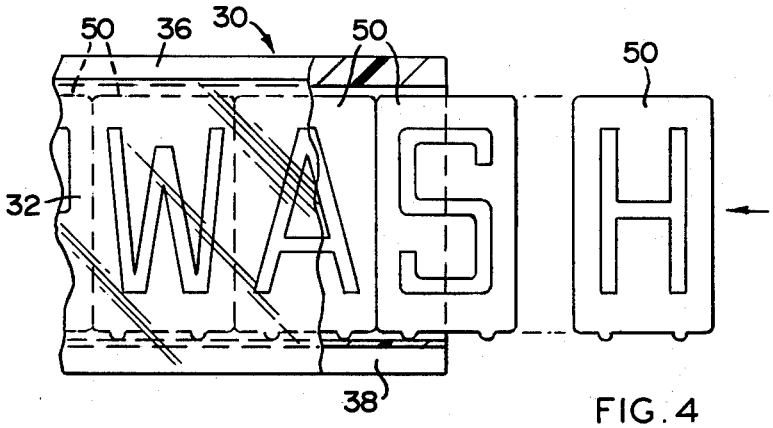
FIG. 4
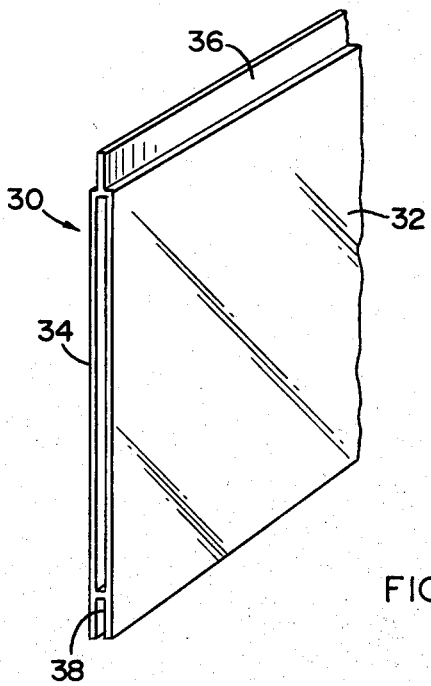
FIG. 5

DISPLAY SIGN AND REPLACEABLE MESSAGE

BACKGROUND OF INVENTION

Heretofore there have been many, many different types of signs provided and many of these signs are so made that interchangeable indicia or messages can be presented on the sign at different intervals. Many of these prior signs have included pairs of vertically spaced holding strips so that letters can be slidably engaged with the strips from the ends thereof to provide a replaceable message. Typical patents on prior structures in this field would include U.S. Pat. Nos. 1,887,591; 1,400,438 and 1,779,190.

Furthermore, many specialized types of signs have been provided in the past where indicia are positioned on members such as upwardly slanted receiving bars and wherein the actual indicia used are correspondingly slotted to engage these positioning bars. A representative patent in such field U.S. Pat. No. 2,941,323.

The general object of the present invention is to provide a novel and improved display sign having members therein for receiving replaceable indicia that are received in flattened tubular indicia carriers provided in the sign.

Another object of the invention is to create a display sign having novel extruded flattened tubular plastic indicia carries that form a vertical panel in the sign and which indicia carriesr engage each other at adjacent top and bottom edge areas of the indicia carriers by slidably interlocking members provided thereon.

Another object of the invention is to provide a display sign including frame means forming an enclosed center area and wherein a portion of the frame means is removably or pivotally positioned to be opened to permit access to the center area of the sign wherein interlocked indicia carries are positioned with removable indicia plates received in the individual indicia carriers.

Yet another object of the invention is to provide an attractive, sturdy, relatively inexpensive sign of novel design and wherein the components of the sign can have a long service life and wherein the message of the sign can be easily altered and will be attractively displayed.

The foregoing and other objects and advantages of the invention will be made more apparent as the specification proceeds.

Attention now particularly is directed to the accompanying drawings, wherein:

FIG. 1 is an elevation of a display sign embodying the principles of the invention;

FIG. 2 illustrates how one end portion of the sign frame of FIG. 1 can be opened to permit indicia carriers therein to be removed or changed;

FIG. 3 is an enlarged, partly broken away, vertical section taken on line 3—3 of FIG. 1;

FIG. 4 is an enlarged elevation, partially broken away and shown in section of an indicia carrier of the invention with indicia plates being shown therein; and FIG. 5 is a perspective view of an indicia carrier of the invention.

When referring to corresponding members shown in the drawings and referred to in the specification, corresponding numerals are used to facilitate comparison therebetween.

INVENTIVE SUBJECT MATTER

The present invention, as one embodiment thereof, relates to a display sign comprising a frame means enclosing an accessible center area, a plurality of flattened tubular, vertically aligned indicia carriers filling the center area of the frame means and being removable therefrom. The indicia carriers are slidably interlocked with each other, and indicia plates are slidably received in one or more of the indicia carriers which indicia plates are visible through a transparent front wall of the indicia carrier.

Attention now is particularly directed to details of the present invention and a display sign 10 of the invention. This display sign comprises a frame means 12 for the display portion of the sign and with support posts 14 being shown secured to a base 16 and extending to and mounting the frame means 12 for the display portion of the sign.

The frame means for the display area or portion of the sign can be of substantially conventional construction and can be of any suitable contour to enclose a center area. The shown frame means includes sections 18 and 19 that are horizontally extending to form top and bottom portions of the frame, and vertically extending frame sections 20 and 22. These end frame sections 20 and 22 usually extend vertically and access is provided to an enclosed center area 13 defined by the frame means as by making the end section 22 be removable or be pivotally connected to the upper horizontal section 18 as by a hinge member 24. Hence, the end section 22 can be swung upwardly so that access is provided to the interior of the display area 13.

As an important feature of the present invention, a plurality of flattened tubular indicia carriers are mounted in the frame means 12 and such indicia carriers normally fill the display area 13 thereof. A plurality of indicia carriers 30 are shown and these members are of uniform vertical section. The carriers 30 preferably are formed from a plastic material and they can be made by conventional molding or extrusion action, as desired. Usually the plastic used in forming the indicia carrier 30 is transparent and each indicia carrier has a front face 32 and a rear face 34. Normally the indicia carriers are all positioned in a vertical plane and indicia mounted in the display sign 10 is visible from the front faces 32 of the various individual indicia carriers. An attractive, sturdy and practical support or positioning action for the different indicia carriers is provided by slidably interlocking these members at the top and bottom edges thereof. Thus, each of the indicia carriers 30 has a vertically upwardly protruding rib 36 thereon that extends the length thereof. This rib 36 is adapted to slidably interlock with a longitudinally extending recess 38 formed in the bottom edge of each of the indicia carriers and it is formed, if desired, from a pair of protruding parallel flanges on the lower edge of each indicia carrier and extending the length thereof. Hence, adjacent pairs of the indicia carriers can be readily interlocked with each other and can be individually slid out of the display area 13 of the frame means when the end section 22 is swung upwardly as indicated in FIG. 2 of the drawings.

Obviously, the frame means or sections can be made from any suitable material and be of any desired design. Furthermore, the entire frame means 12 could even be round, or the frame means could be of triangular shape and the novelty of the invention still can reside in the fact that a plurality of slidably interlocked indicia carriers are present in an enclosure formed by the frame. Such indicia carriers still would form a vertical plane, usually extending from top to bottom of the display sign.

In most instances, it is desired to have the indicia carriers 30 slidably interlock with the frame means 12 at the top and bottom margins of the enclosed center area defined by the frame means. FIG. 3 of the drawings shows that the upper horizontal frame section 18 has a downwardly extending pair of spaced parallel ribs 40 and 42 thereon which are so positioned and sized as the engage with the upwardly extending rib 36 on each of the individual indicia carriers 30. Likewise, the bottom horizontal section 19 of the frame has an upwardly extending rib 44 thereon and this is adapted to engage the recess 38 formed in the bottom edge of each of the indicia carriers. Hence, all of the indicia carriers are slidably engaged at top and bottom margins thereof with adjacent members, either the frame means or an adjacent indicia carrier. Since the indicia carriers can be made from relatively hard or rigid plastic materials, low frictional engagement between the indicia carriers is achieved and the individual indicia carrier can be telescoped laterally inwardly or outwardly of the sign quite easily.

The actual indicia to be displayed in the display sign 10 preferably comprises members such as indicia carrying plates 50, as shown in FIGS. 3 and 4 of the drawings. These plates 50 can be made from plastics or other conventional materials as desired. The plates 50 are shown as being substantially rectangular and having any suitable indicia, letter or marking insignia provided thereon. Of course, the plates 50 can be spacers or blanks as desired. Usually the plates 50 would be abutted on each other laterally of the actual indicia carrier in which it is received whereby the letters can be spaced and held in desired relationship to each other and other portions of the sign.

In some display signs as made in accordance with the invention, it may be desirable to provide some type of a back light therein and any conventional back light could be positioned within the sign display 10 and the frame means thereof. Likewise, enclosure plates or glass panes can be positioned in the frame means 12 in any suitable manner, usually with a transparent or glass panel being provided in front of the indicia carriers 12 and with some safety enclosure panel being present in the apparatus spaced from the back portion of the indicia carriers.

It also may be desirable to paint or cover the rear faces 34 of the indicia carriers with an opaque or translucent coating or paint of any desired nature to facilitate and improve the display of the indicia plates 50 received in the display sign. Or, it may be desired to mold or extrude the indicia carriers so that a transparent front wall is provided thereon, but yet an opaque or translucent rear face or wall is formed thereon by using a different plastic material or a different composition of material when forming the flattened tubular carriers 30. Such carriers will be positioned in any suitable frame that has access to the open center area thereof.

It will be seen that it is quite easy to change the message carried by the display sign 10 and that it can be altered readily as desired. The sign can be protected as indicated hereinabove by front facing and rear covering panels, or the indicia carriers 30 themselves will form a good front facing for the sign, as desired. Any suitable lighting can be provided in or about the sign 10. The plastic indicia carriers have good service lives and are well adapted to withstand the elements and weathering conditions. The sign likewise forms good protection for the indicia plates provided thereby. Hence, it is believed that the objects of the invention have been achieved and that a novel, attractive, useful and relatively inexpensive display sign is formed by the invention.

While one complete embodiment of the invention has been disclosed herein, it will be appreciated that modification of this particular embodiment of the invention may be resorted to without departing from the scope of the invention.

What is claimed is:

1. A sign comprising a frame means enclosing an accessible center area and having a frame section movable to expose an edge of said center area, a plurality of flattened tubular vertically aligned transparent indicia carriers filling said center area, said indicia carriers each including a vertically extending and protruding rib at one vertical margin thereof, which rib extends longitudinally of said indicia carrier, and a vertically extending recess extending longitudinally of the carrier at the other vertical margin thereof and open at such vertical margin thereof to engage and interlock with the rib of an adjacent one of said indicia carriers, said ribs and recesses of adjacent ones of said indicia carriers being slidably interlocked with each other, and indicia plates slidably received in and positioned by the walls of at least one indicia carrier, said indicia plates being visible through a front wall of said indicia carriers.

2. A sign as in claim 1 wherein said indicia carriers are made of relatively rigid plastic and each including an opaque or translucent rear wall, said indicia carriers being slidable out of said frame means at one margin thereof, said indicia carriers engaging to form a flat self supporting structure defining a plane in which said indicia plates are positioned.

3. A sign as in claim 2 where said frame includes means for slidably interlocking with at least the bottom one of said indicia carriers, and where said indicia carriers enclose said indicia plates and form a structure that can withstand weathering conditions.

4. A sign having changeable indicia presented thereby and comprising a frame enclosing an open center area and including two generally vertically extending side members one of which is removable, a plurality of flattened tubular vertically aligned indicia carriers filling said center area, said indicia carriers each being of planar shape and being vertically positioned, said indicia carriers being formed with complementary vertically extending rib and groove interlocking means on the top and bottom thereof for slidable interlock with mating means on a vertically adjacent indicia carrier, said interlocking means lying in the planes of said indicia carriers, vertically adjacent pairs of said indicia carriers being slidably interlocked with each other, and indicia plates slidably carried in and by said indicia carriers, said indicia carriers having a transparent front wall and enclosing said indicia plates.

* * * * *

UNITED STATES PATENT OFFICE

CERTIFICATE OF CORRECTION

PATENT NO. : 4,048,738

DATED : Sept. 20, 1977

INVENTOR(S) : Edward R. McHenry

It is certified that error appears in the above-identified patent and that said Letters Patent are hereby corrected as shown below:

Column 1, line 28, "carries" should be -- carriers --

Column 1, line 29, "carriesr" should be -- carriers --

Column 1, line 37, "carries" should be -- carriers --

Column 3, line 7, "the" should be -- to --

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*